United States Patent [19]

Lardellier

[11] Patent Number: 4,762,462

[45] Date of Patent: Aug. 9, 1988

[54] HOUSING FOR AN AXIAL COMPRESSOR

[75] Inventor: Alain M. J. Lardellier, Melun, France

[73] Assignee: Societe Nationale d'Etude et de Construction de Moteurs d'Aviation (SNECMA), Paris, France

[21] Appl. No.: 124,599

[22] Filed: Nov. 24, 1987

[30] Foreign Application Priority Data

Nov. 26, 1986 [FR] France ..... 86 16448

[51] Int. Cl.[4] ..... F01D 25/08

[52] U.S. Cl. ..... 415/177; 415/139

[58] Field of Search ..... 415/177, 175, 178, 134, 415/136, 137, 138, 139

[56] References Cited

U.S. PATENT DOCUMENTS

| | | | |
|---|---|---|---|
| 3,319,930 | 5/1967 | Howald | 415/190 |
| 3,335,483 | 8/1967 | Howald | 29/156.8 |
| 3,824,031 | 7/1974 | Gilbert | 415/135 |
| 3,892,497 | 7/1975 | Gunderlock et al. | 415/139 |
| 4,101,242 | 7/1978 | Coplin et al. | 415/134 |
| 4,131,388 | 12/1978 | Brodell | 415/138 |
| 4,191,510 | 3/1980 | Teysseyre et al. | 416/230 |
| 4,411,594 | 10/1983 | Pellow et al. | 415/174 |
| 4,426,191 | 1/1984 | Brodell et al. | 415/189 |
| 4,431,373 | 2/1984 | Monsarrat | 415/189 |
| 4,522,559 | 6/1985 | Burge et al. | 415/196 |
| 4,543,039 | 9/1985 | Ruis et al. | 415/190 |
| 4,573,867 | 3/1986 | Hand | 415/134 |
| 4,696,619 | 9/1987 | Lardellier | 415/138 |

FOREIGN PATENT DOCUMENTS

| | | |
|---|---|---|
| 975879 | 3/1951 | France . |
| 2422026 | 11/1979 | France . |
| 2482661 | 11/1981 | France . |
| 2482662 | 11/1981 | France . |
| 2534982 | 4/1984 | France . |

*Primary Examiner*—Robert E. Garrett
*Assistant Examiner*—John T. Kwon
*Attorney, Agent, or Firm*—Bacon & Thomas

[57] ABSTRACT

A housing for an axial compressor is disclosed having an inner and outer wall surrounding the compressor rotor, the walls being joined by a number of flexible connecting rods, connecting lugs and a connecting block. An outer surface of the inner wall has circumferentially extending corrugation and the rods are attached thereto at peaks in the corrugation. The flexible connecting rods are located in alignment with a leading edge and a trailing edge of stator vanes which extend from an inner surface of the inner wall. The housing may be cast as an integral, one piece element and subsequently subdivided into arcuate segments to facilitate attachment to the compressor.

6 Claims, 3 Drawing Sheets

HOUSING FOR AN AXIAL COMPRESSOR

BACKGROUND OF THE INVENTION

The present invention relates to a housing for an axial-type compressor which will accommodate the expansions and contractions of the compressor, and a process for manufacturing the housing.

Axial gas turbine engine compressors typically have a rotor wheel assembly having a plurality of stages of rotor blades mounted thereon. Such compressors also incorporate several rows of stator vanes which are disposed between the rotor blades in a longitudinal direction. The stator vanes are rigidly affixed to an outer envelope or housing that forms part of the compressor case.

French Pat. No. 2,482,661 as well as U.S. Pat. Nos. 4,431,373 and 4,426,191 disclose typical examples of such a gas turbine compressor wherein the stator vanes are attached to an inner shell formed of peripheral segments and which, in turn, is attached to an outer shell by radial flanges. The radially inner ends of the stator vanes are joined to an inner collar and the stator assembly is surrounded by an air cooling manifold.

Other examples are shown in French Pat. No. 2,534,982 and U.S. Pat. No. 4,543,039 wherein the segments of the inner shell are hooked or otherwise fastened to an outer shell to form the compressor case. U.S. Pat. No. 4,696,619 provides the compressor housing with a plurality of longitudinally extending pins to attach the inner shell segments to the outer shell.

The object of these known systems is to maintain a slight, but constant clearance between the rotor and the stator regardless of the operating conditions of the gas turbine engine. This is of particular importance during the transitional stages of acceleration and deceleration to maintain acceptable levels of engine performance, efficiency and specific fuel consumption. Although the known examples may achieve these improved results, their implementation serves to increase the complexity of the engine structure and increases the difficulty of assembly and disassembly due to the large number of parts involved. This complexity also serves to increase both the cost of the compressor and the weight of the assembled engine.

SUMMARY OF THE INVENTION

It is an object of the present invention to achieve improved performance, efficiency and specific fuel consumption of the gas turbine engine by providing a compressor housing which does not incorporate the drawbacks of the known devices. The axial compressor housing of the present invention comprises an inner wall disposed circumferentially around the rotor assembly of the compressor, an outer wall disposed concentrically around the inner wall so as to define a generally annular space therebetween, and a plurality of flexible rods extending through this annular space and interconnecting the inner and outer walls. An outer surface of the inner wall defines a plurality of generally circumferentially extending corrugations which define alternating troughs and peaks in the longitudinal direction of the housing. The flexible rods have their inner ends attached to the outer surface of the inner wall at peaks of the corrugations and are aligned with either a leading edge or a trailing edge of the stator vanes attached to the inner wall. The stator vanes may be attached to the inner surface of the inner wall and extend in a radially inner direction. The radially innermost ends of the stator vanes are connected by an annular collar.

The housing may be formed in a plurality of arcuate segments, each segment having a plurality of rods interconnecting the segments of the inner and outer walls. In addition, a connecting block extends between the inner and outer walls of each segment and is located approximately at the geometric center of each segment. Elongated connecting lugs also inter-connect the inner and outer walls of each segment, one connecting lug having its elongated dimension extending in a circumferential direction, the other connecting lug having its elongated dimension extending in the longitudinal direction.

The outer wall may also be corrugated to match the corrugations of the outer surface of the inner wall such that the annular space therebetween has a substantially constant radial dimension. In this instance, the outer ends of the connecting rods are attached to troughs of the outer wall corrugations.

The invention also encompasses a method for manufacturing the housing wherein duplicates of the inner and outer walls are formed from a meltable solid material and disposed on either side of a ceramic core which defines a plurality of openings having the desired shape of the connecting rods, lugs and blocks. This assembly is placed in a heat resistent mold and molten metal is poured into the mold such that the meltable material evaporates allowing the molting metal to fill the void therein. Upon curing the molten metal, the housing is formed in a single, integral piece with the inner and outer walls surrounding the ceramic, heat resistant core. The molten metal passes through the openings defined in the core to form the connecting rods, lugs and blocks.

The housing may subsequently be cut into two semicylindrical housing portions, each portion being further subdivided into a plurality of arcuate segments to facilitate assembly of the housing onto the compressor.

A BRIEF DESCRIPTION OF THE DRAWINGS

FIG. 1 is a partial, longitudinal cross sectional view taken along a plane passing through the axis of rotation of the compressor showing the compressor housing according to the invention.

FIG. 1*a* is a perspective view showing an alternative embodiment of the compressor housing according to the invention wherein the housing is formed in semicylindrical housing portions.

DETAILED DESCRIPTION OF THE PREFERRED EMBODIMENTS

Figure 1:
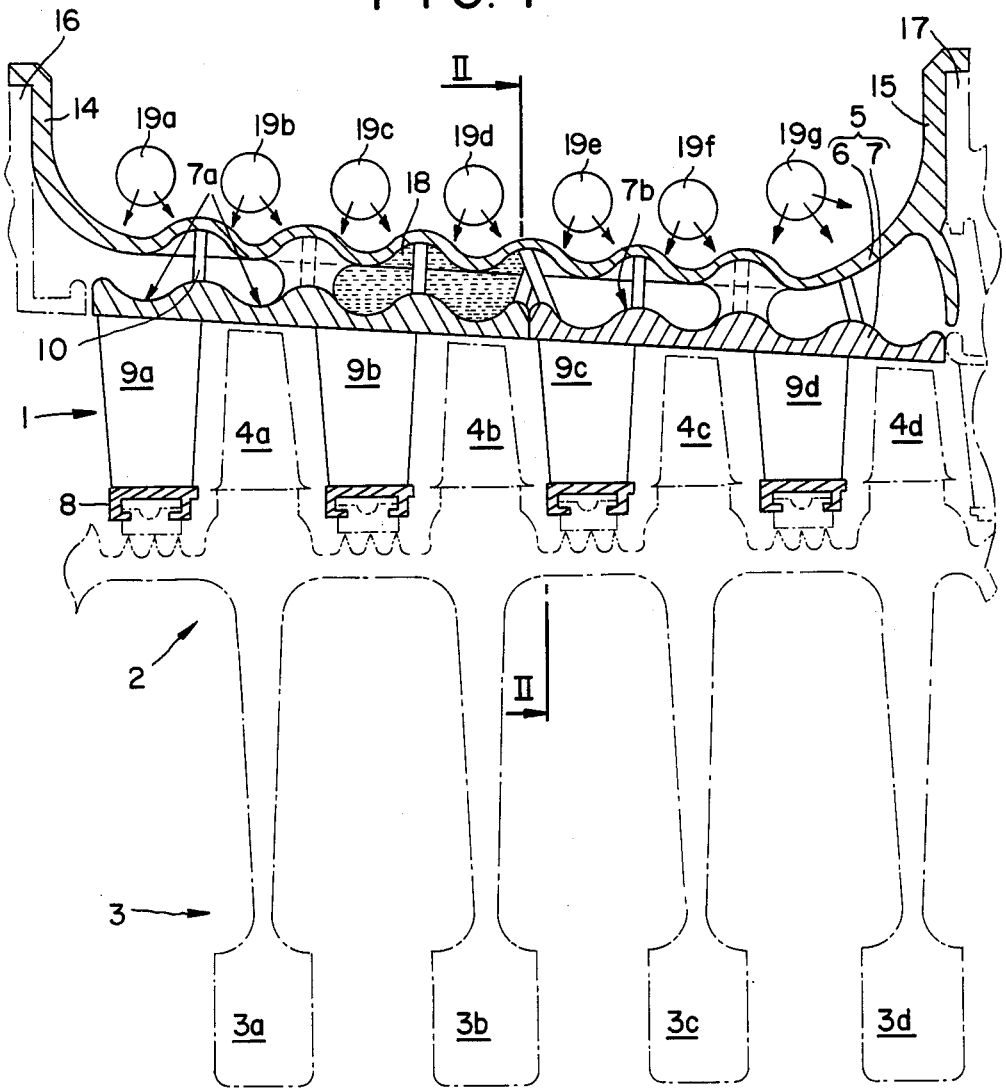
Figure 2:
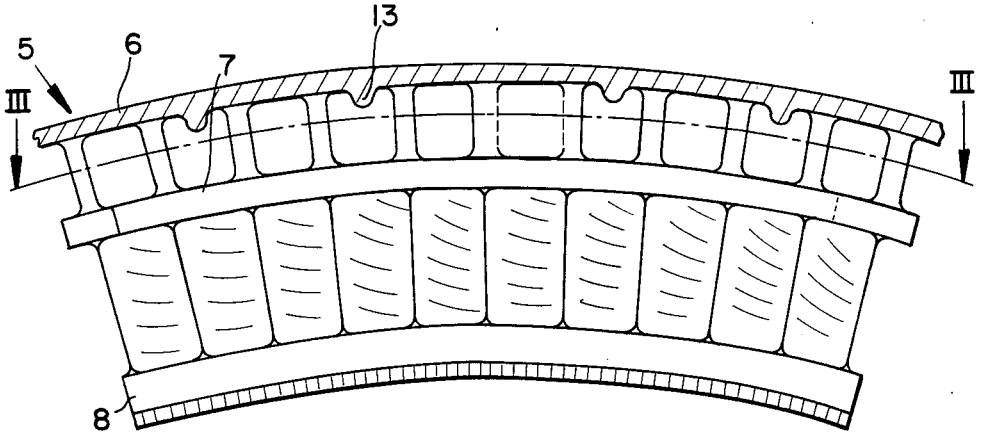
FIG. 2 is a partial, cross sectional view taken along line II—II in FIG. 1.

A portion of an axial-type compressor 1 is shown in FIG. 1 and comprises a rotor assembly 2, indicated in phantom lines, which consists of a plurality of rotor disks 3*a*, 3*b*, 3*c* and 3*d*. Although four such disks are illustrated, it is to be understood that rotor 3 may be comprised of more or less rotor disks. Each of the rotor disks has a rotor blade stage mounted thereon, illustrated at 4*a*, 4*b*, 4*c* and 4*d* in FIG. 1. A compressor housing 5 surrounds the blade tips of the rotor assembly such that a gas passage is defined therebetween to allow the gas to pass over the rotor blades to thereby drive the rotor assembly.

Figure 1A:
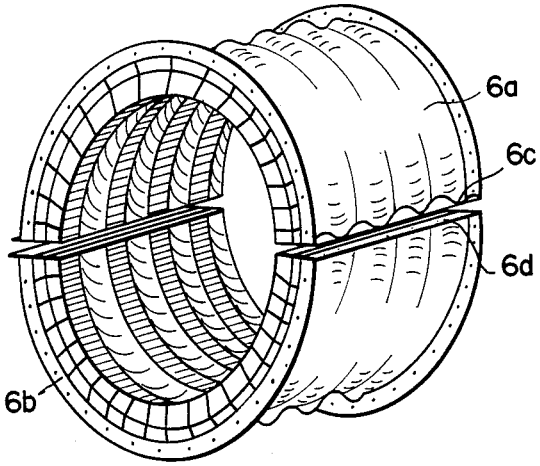

The compressor housing 5 comprises an outer wall 6 and an inner wall 7, both arranged concentrically with each other and with the longitudinal axis of the compressor. The outer wall 6 may be formed from one piece or, alternatively, may be formed into semi-cylindrical portions 6*a* and 6*b* joined longitudinally by flanges 6*c* and 6*d* as shown in FIG. 1*a*.

A plurality of stator vanes, 9*a*, 9*b*, 9*c* and 9*d* extend from the inner surface of inner wall 7 between the stages of the rotor wheel. The radially innermost ends of the stator vane are interconnected by annular collars 8. Annular collars 8 serve as inner boundaries to the gas flow passage in those longitudinal spaces between the rotor blades.

Figure 3:
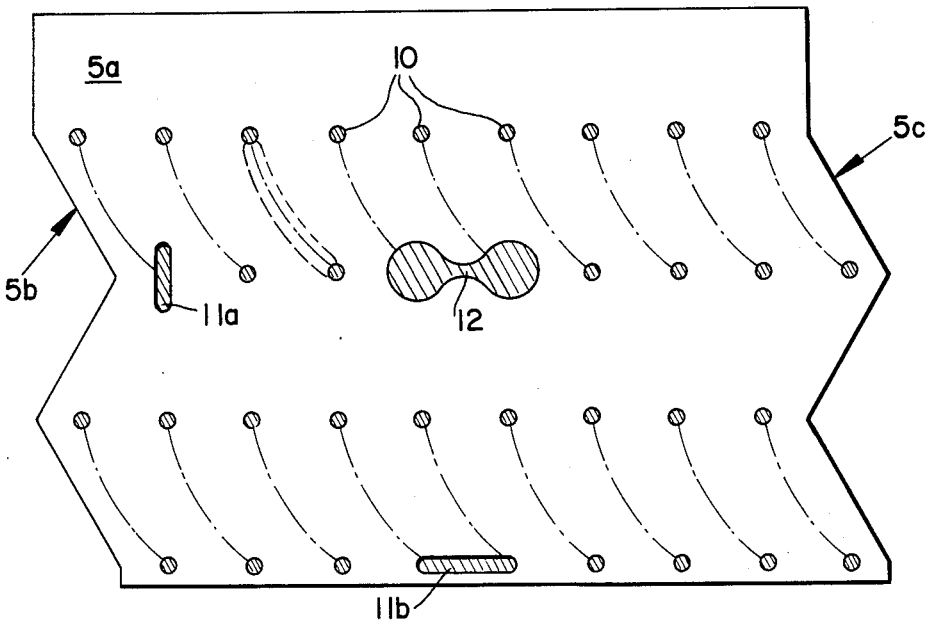
FIG. 3 is a sectional view taken along line III—III in FIG. 2.

The housing may be formed from a plurality of arcuate segments, one such segment being illustrated at 5*a* in FIG. 3. Each segment 5*a* comprises a segment of the outer wall 6, the inner wall 7 and has two rows of stator vanes extending from the inner surface of the inner wall segment 7. Eight of the segments shown in FIG. 3 are necessary to form the annular housing 5. Two rows of the completed segments are shown in FIG. 1 to provide the necessary four rows of stator vanes. The cooperating edges of 5*b* and 5*c* of each of the sectors 5*a* has a generally Z shape as illustrated in FIG. 3.

Figure 4:
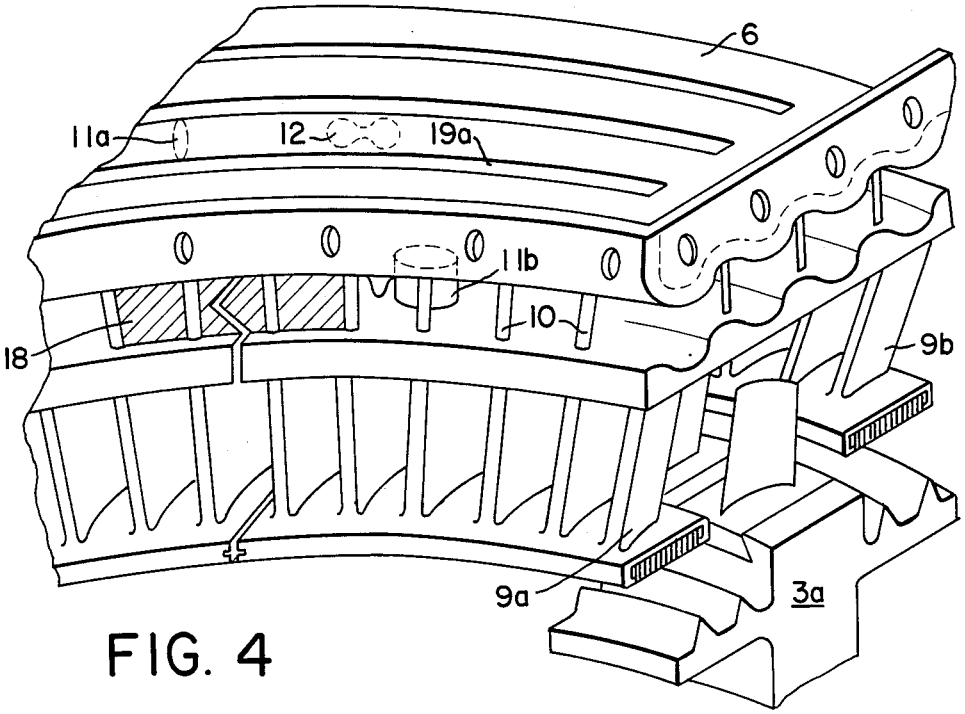
FIG. 4 is a partial, perspective view of the compressor housing shown in FIGS. 1–3.

As shown in FIGS. 1 and 4, the inner wall 7 has an outer facing surface which defines a plurality of generally circumferentially extending corrugations such that a profile of the outer surface defines alternating troughs 7*a* and peaks 7*b* in the longitudinal direction. A trough 7*a* of a corrugation is located approximately at the center of a row of stator vanes 9, while a peak 7*b* of a corrugation is located approximately at the leading and trailing edges of the stator vanes.

A plurality of flexible rods 10 interconnect the inner wall 7 and the outer wall 6 in a rigid manner. Each rod 10 is fixed to a peak 7*b* of a corrugation of inner wall 7 while the outer end of the flexible rods 10 are connected to outer wall 6. As illustrated in FIG. 3, the rods are also positioned such that the they are in alignment with either a leading edge or a trailing edge of a stator vane.

Each segment 5*a* also has elongated connecting lugs 11 interconnecting the inner and outer walls. Elongated lug 11*a* is oriented such that its elongated dimension extends substantially parallel to the longitudinal axis of the compressor. Elongated lug 11*b* is oriented such that its elongated dimension extends in a substantially circumferential direction, generally perpendicular to that of 11*a*. This orientation of the connecting lugs 11 enables the housing to withstand the torque supplied thereto during the operation of the compressor. Connecting block 12 also interconnects inner wall 7 with outer wall 6 and is located approximately in the geometric center of each segment 5*a*.

Preferably the outer wall 6 is formed in one piece and it may constitute a generally cylindrical element having smooth inner and outer surfaces, or it may have a corrugated profile as shown in FIG. 1. The corrugations defined by the outer walls 6 are oriented such that they are coincident with the corrugations formed on the outer surface of inner wall 7 thereby enabling the annular space between the inner and outer wall to have a substantially constant radial dimension. When outer wall 6 is formed with corrugations, the outer ends of flexible rods 10 are attached to the trough 6*a* of the corrugation. The corrugations of the outer wall 6 and the inner wall 7 are located in approximately the same transverse plane extending perpendicular to the axis of rotation of the compressor.

Longitudinally extending reinforcing ribs 13 may be formed on the inner side of the outer wall 6 to provide the requisite rigidity to the housing. Outer wall 6 is attached to flanges 16 and 17 of the compressor by radially extending flanges 14 and 15 respectively. The annular space between inner wall 7 and outer wall 6 may be filled with a ceramic, thermal insulating material 18 which may also act as a seal between adjacent segments 5*a* to prevent gas recirculation between the wall of the housing from the main gas flow.

Perforated tubes 19*a*–19*g* are located near the outer surface of outerwall 6 opposite each corrugation trough and comprise an air distribution manifold which directs a flow of air onto the outer surface of outer wall 6 from another stage of the compressor in known fashion.

The housing 5 consisting of outer wall 6, inner wall 7, flexible rods 10, connecting lugs 11 and connecting block 12, as well as stator vanes 9*a* and 9*b* can be manufactured in one piece by a lost-wax casting process. Duplicates of outer walls 6 and 7 are formed from a meltable, solid material (such as wax) and then placed around a ceramic core. The ceramic core defines a plurality of radially extending openings having the desired shape of the rods, lugs and connecting blocks. This assembly is placed within a heat resistent mold and molten metal is poured into the mold such that the wax melts and evaporates enabling the molten metal to fill the void previously occupied by the wax. After the metal has solidified and the heat resistent mold has been removed, the inner and outer walls, as well as the rods, lugs and connecting blocks are all formed in a single, integral piece. The ceramic core is retained between the inner and outer wall to serve as thermal insulation.

Following the formation as a single, integral element, the housing may be divided along a longitudinal plane so as to form two semi-cylindrical housing portions. Flanges attached to the housing portions enable them to be assembled around the rotor and to be affixed in position.

Each of the semi-cylindrical housing portions may be further subdivided into the arcuate segments shown in FIG. 3. Alternatively, the semi-cylindrical housing portions may be cast individually and subsequently either attached together, or further subdivided into the arcuate segments. In each case, the same manufacturing process is utilized.

The foregoing description is provided for illustrative purposes only and should not be construde as in any way limiting this invention, the scope of which is defined solely by the appended claims.

I claim:

1. A housing for an axial compressor having a rotor assembly rotatable about a longitudinal axis of the compressor with at least one row of rotor blades extending radially outwardly therefrom, the housing comprising:

(a) an inner wall disposed circumferentially around the rotor assembly and having i) a radially inner surface defining, with the rotor assembly, a gas passage therebetween; and ii) a radially outer surface defining a plurality of generally circumferentially extending corrugations, the corrugations defining alternating troughs and peaks in a longitudinal direction;

(b) an outer wall disposed circumferentially around the inner wall so as to define a generally annular space therebetween;

(c) a plurality of stator vanes attached to the inner surface of the inner wall, each stator vane having a leading edge and a trailing edge, each stator vane being located such that the leading and trailing edges are longitudinally aligned with a peak of the circumferentially extending corrugations; and, (d) a plurality of flexible rods extending through the annular space having a first end attached to a peak of the inner wall and a second end attached to the outer wall, each first end being aligned with either a leading edge or a trailing edge of a stator vane.

2. The axial compressor housing according to claim 1 further comprising an annular collar attached to radially innermost ends of the stator vanes.

3. The axial compressor housing according to claim 2 wherein the inner and outer walls are formed from arcuate segments, and further comprising:

(a) a connecting block interconnecting the inner and outer walls, and located in the approximate geometric center of each arcuate segment;

(b) a first elongated connecting lug interconnecting the inner and outer walls of each arcuate segment and oriented such that its elongated dimension extends in a substantially circumferential direction; and (c) a second elongated connecting lug interconnecting inner and outer walls of each arcuate segment and oriented such that its elongated dimension extends in a substantially longitudinal direction.

4. The axial compressor housing according to claim 3 wherein the outer wall defines a second plurality of generally circumferentially extending corrugations, the second corrugations being substantially concentric with the corrugations on the inner wall such that the generally annular space between the inner and outer walls has a substantially constant radial dimension.

5. The axial compressor housing according to claim 4 further comprising thermal insulating material disposed in the generally annular space between the inner and outer

6. The axial compressor housing according to claim 5 further comprising a plurality of cooling ducts disposed adjacent to an outer surface of the outer wall.

* * * * *

UNITED STATES PATENT AND TRADEMARK OFFICE

CERTIFICATE OF CORRECTION

PATENT NO. : 4,762,462

DATED : August 9, 1988

INVENTOR(S) : Alain M. J. LARDELLIER

It is certified that error appears in the above-identified patent and that said Letters Patent is hereby corrected as shown below:

Column 3, line 42, delete "the".

Column 4, line 53, "construde" should be --construed".

Column 6, line 20, claim 5, add --walls-- after "outer".

Signed and Sealed this

Twenty-seventh Day of December, 1988

*Attest:*

DONALD J. QUIGG

*Attesting Officer*

*Commissioner of Patents and Trademarks*